United States Patent [19]

Popa

[11] 4,331,139

[45] May 25, 1982

[54] EMERGENCY BREATHING APPARATUS

[76] Inventor: Mihai Popa, 4803 Bonvue Ave., Los Angeles, Calif. 90027

[21] Appl. No.: 273,732

[22] Filed: Jun. 15, 1981

[51] Int. Cl.[3] ..... A62B 7/00

[52] U.S. Cl. ..... 128/202.13; 128/205.28; 128/206.12; 128/206.28; 128/207.12

[58] Field of Search ..... 128/200.24, 201.22, 128/201.23, 201.24, 201.25, 201.26, 201.27, 201.28, 201.29, 202.13, 202.19, 204.18, 205.25, 206.12, 206.21, 206.27, 206.28, 207.12

[56] References Cited

U.S. PATENT DOCUMENTS

| | | | |
|---|---|---|---|
| 281,027 | 7/1883 | Cottier | 98/42 R |
| 428,592 | 5/1890 | Chapman | 128/205.25 |
| 472,163 | 4/1892 | Duffy | 98/33 R |
| 642,166 | 1/1900 | Sherman | 128/201.29 |
| 835,075 | 11/1906 | Mahaffy | 128/207.12 |
| 839,486 | 12/1906 | Lafave | 128/202.13 |
| 1,005,196 | 10/1911 | Gold et al. | 128/205.25 |
| 1,007,644 | 10/1911 | Cocke | 128/207.12 |
| 1,040,311 | 10/1912 | Halloran | 128/202.13 |
| 1,413,275 | 8/1922 | Howard | 116/214 |
| 1,786,969 | 12/1930 | Van Der Heuel | 237/50 |
| 2,014,840 | 9/1935 | Geiger et al. | 98/33 R |
| 2,299,273 | 10/1942 | Cannaday et al. | 128/205.25 |
| 2,679,795 | 6/1954 | Geiger et al. | 98/29 |
| 3,503,394 | 3/1970 | Hotz et al. | 128/206.27 |
| 3,739,707 | 6/1973 | Knapp | 98/33 R |
| 3,817,161 | 6/1974 | Koplon | 98/39 |
| 3,926,101 | 12/1975 | Moss | 98/33 R |
| 3,945,800 | 3/1976 | Roos | 23/232 R |
| 4,058,253 | 11/1977 | Munk et al. | 236/46 R |
| 4,068,568 | 1/1978 | Moss | 98/33 R |
| 4,154,237 | 5/1979 | Courter | 128/206.27 |
| 4,165,738 | 8/1979 | Graves et al. | 128/205.25 |
| 4,174,711 | 11/1979 | Laing et al. | 128/205.25 |

FOREIGN PATENT DOCUMENTS

| | | | |
|---|---|---|---|
| 17913 | of 1891 | United Kingdom | 128/200.24 |

*Primary Examiner*—Henry J. Recla

*Attorney, Agent, or Firm*—Poms, Smith, Lande & Rose

[57] ABSTRACT

An emergency breathing apparatus allows a human user to breathe safely within a structure whose interior is devoid of sufficient breathable air as a result of fire, etc. The apparatus communicates with the soil or waste vent in the structure and includes an air collector disposed for access by the human user within the structure. The air collector allows air to flow from the soil vent into the structure. A breathing mask with an internal diaphragm is coupled to the air collector and allows the user to inhale the air within the air collector and exhale air into the environment. A control valve is disposed between the air collector and the breathing mask and enables air to flow from the air collector into the breathing mask. Accordingly, when the interior environment of the structure is devoid of sufficient breathable air, the human user, may, via the control valve, enable air to flow from the soil vent to the breathing mask and thereafter breathe that air for survival.

20 Claims, 4 Drawing Figures

EMERGENCY BREATHING APPARATUS

FIELD OF THE INVENTION

The present invention relates generally to emergency breathing systems, and particularly to emergency breathing systems designed for permanent installation in buildings.

BACKGROUND OF THE INVENTION

Most fatalities in structural fires result from smoke inhalation rather than from burns. The smoke inhalation problem is particularly acute in taller buildings such as hotels and high-rise office buildings, where a serious fire on the lower floors can flood the upper floors with so much smoke that it is impossible for the building occupants to either breathe or to move through the building to an emergency exit.

Many systems have been designed to remove smoke from high-rise buildings. Such art is exemplified by U.S. Pat. Nos. 4,058,253 (Munk); 4,068,568 (Moss); and 3,817,161 (Koplon). These systems use various electrical and/or mechanical devices to monitor the smoke content of a building and to remove the smoke from the building. None of these types of systems, however, provide any emergency breathing system for the structure.

Only a few intentions have been specifically directed toward providing an emergency breathing system for permanent installation in structures such as high-rise buildings. Such inventions are quite complicated mechanically and operationally. One such invention is described in U.S. Pat. No. 4,174,711 (Laing et al). Laing discloses a breathing system within a fire resistant enclosure having a heat insulating layer covered by a layer of meltable substance to provide additional heat insulation. The disadvantage of the devices typified by Laing is that they are expensive to fabricate and complicated mechanically.

All buildings, both commercial and residential, are provided with a source of potentially breathable air, which could be accessed in a time of emergency. This source of air is the soil or waste vent, which is connected to the waste disposal pipes in the building. Such vents run between the waste pipes and the atmosphere and always contain at least some air. No prior art device has either recognized this source of air or has suggested a means for accessing this source. The extremely attractive feature of using the vent pipe as an emergency source of air is that such pipes pass through all floors of the building and have tributaries passing extending thoughout each of the floors in the building. Therefore, accessing such a source requires only an opening in the building wall or ceiling.

Accordingly, it is the principal object of the present invention to utilize the soil vent system in buildings to provide a source of breathable air in an emergency.

It is another object of the present invention to provide a source of breathable air for buildings with only minor structural modification to the buildings.

It is yet another object of the present invention to provide an emergency source of air within buildings in a simple and economical manner.

SUMMARY OF THE INVENTION

The present invention, in a broad aspect, provides an apparatus for allowing a human user to breathe safety within a structure whose interior environment is devoid of sufficient breathable air. The apparatus communicates with the soil or waste vent system disposed within the structure and includes an air collector, a breathing mask, and a control valve. The air collector is disposed for access by the human user and collects air from the soil vent. The breathing mask is coupled to the air collector and allows the user to inhale the air in the collector. The control valve is positined between the air collector and the breathing mask and enables air to flow from the air collector to the breathing mask. Accordingly, when the interior environment of the structure is devoid of breathable air, the human user may, via the control valve, enable air to flow from the soil vent to the breathing mask and thereafter breathe that air for survival.

In accordance with one feature of the invention, the air collector can include a removable filter to purify the air within the air collector prior to inhalation by the user.

In accordance with another feature of the invention, a monitoring meter may be mounted to the air collector in communication with the air within the collector in order to display, to the human user, an indication of the breathability of the air in the collector.

In accordance with yet another feature os the invention, a master shut-off valve may be provided between the air collector and the soil vent in order to enable or disable the air collector.

In accordance with a further feature of the invention, the connection of the apparatus to the soil vent is made via an air conduit or pipe.

Other objects, features, and advantages of the present invention will become apparent from a consideration of the following detailed description and from the accompanying drawings.

DETAILED DESCRIPTION

Figure 1:
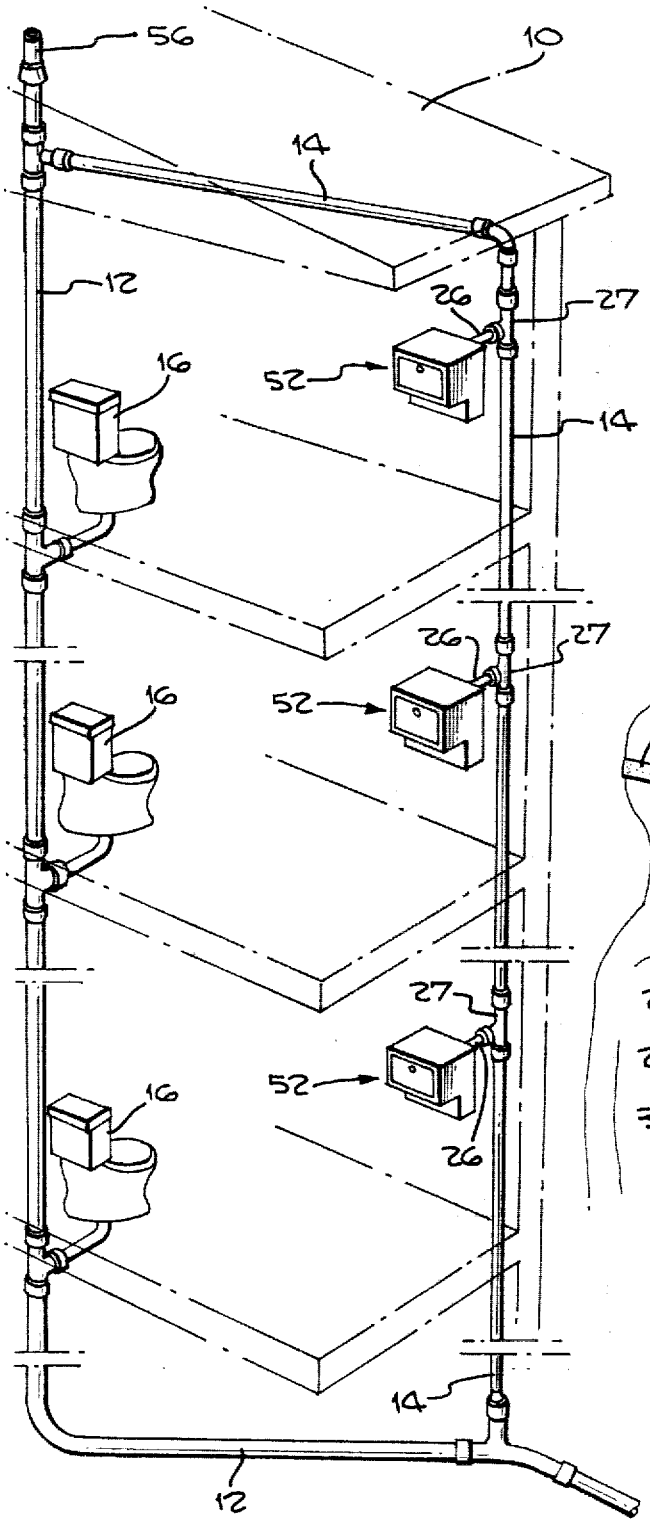
FIG. 1 shows a cross-sectional view of a structure having mounted therein an emergency breathing apparatus according to the present invention.

Referring more particularly to the drawings, FIG. 1 shows a cross-sectional view of a structure having installed therein an emergency breathing apparatus according to the present invention. The structure is generally denoted 10 and contains therein a main soil and waste system, shown diagrammatically as a single pipe 12, connected to a series to lavatories 16. The waste pipe 12 may actually be a series of main and tributary pipes running throughout the structure 10. Attached to the waste pipe 12 is the soil and waste venting system, again shown diagrammatically as a pipe 14. The soil vent 14 may actually be a series of main pipes and tributary pipes which run throughout the building 10.

The soil vent 14 is connected to the waste pipe 12 in at least two places. The first is at a point below the lowest lavatory 16. The second is at the main soil and waste vent 56. The main soil and waste vent 56 is that portion of the soil vent system 14 above the highest installed branch of the waste pipe 12 installed in the structure 10. The main soil and waste vent 56 is the source through which air is admitted into the plumbing system. The soil and waste vent 56 is usually required to be of a larger diameter than the soil vent 14 that it serves, because a number of such soil vents 14 may be connected to one or more such vents 56.

Because the main soil and waste vent 56 that serves as a terminal for many tributaries of the soil vent system 14, the soil and waste vent 56 has the possibility of providing a source of breathable air for the various portions of the soil vent system 14. Accordingly, as the soil vent pipe system 14 runs throughout the structure 10, and usually in close proximity to the waste system 12, it is possible to provide, not only on each floor, but in each lavatory on that floor, as well as in any other location where the soil vent 14 can be easily accessed, a source of breathable air for the occupants of the building 10.

Figure 2:
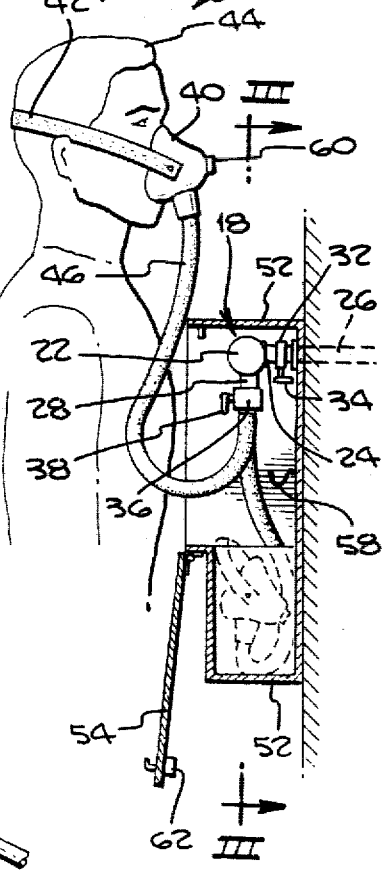
FIG. 2 shows a side view of the emergency breathing apparatus according to the present invention, as well as its use by a human user.
Figure 4:
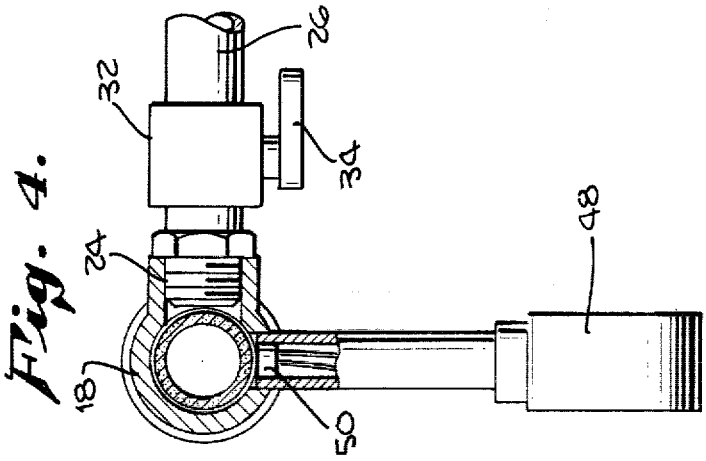
FIG. 4 shows a sectional view of the emergency breathing apparatus according to the present invention, taken through the plane IV—IV in FIG. 3.
Figure 3:
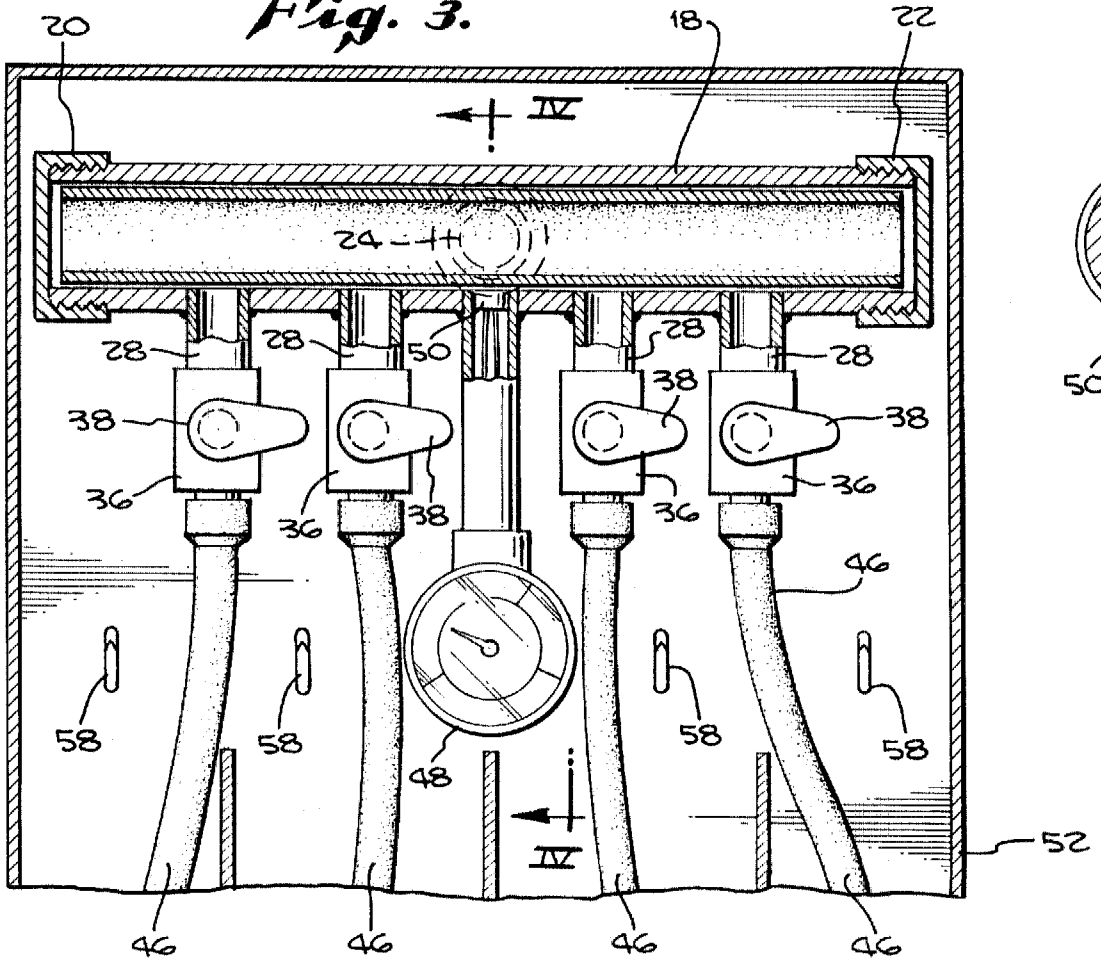
FIG. 3 shows a cross-sectional view of the emergency breathing apparatus according to the present invention taken through the plane III—III in FIG. 2.

FIGS. 2–4 show an emergency breathing apparatus according to the present invention which connects to the soil vent system 14. Turning first to FIG. 3, the emergency breathing apparatus includes an air collector 18 having a pair of end caps 20 and 22 removably threaded thereon. The air collector 18 includes an intake port 24 and a series of exhaust ports 28. As shown in FIGS. 2 and 4, the intake port 24 of the air collector 18 is attached to the soil vent pipe 14 by a conduit 26, which may be a flexible or rigid conduit. The conduit 26 is attached to the soil vent pipe 14 by any convenient means as known in the art. For example, the connection could be via a "T" element 27, as shown in FIG. 1, in the case of new construction. Alternately, in the case of existing construction, a fitting could be attached to the vent system 14 in order to provide a connection of the conduit 26.

The air collector 18 may be made of any convenient material, such as molded plastic or metal. The same is true of the end caps 20 and 22. It should be noted that it would be possible to eliminate one of the end caps 20 or 22 if the air collector 18 was made of molded plastic. As discussed hereinafter, one of the end caps 20 or 22 is needed to allow a filter element 30 disposed within the air collector 18 to be removed and replaced. In an actual prototype of the invention, the air collector 18 was a metal pipe approximately 1¼" in diameter.

The filter 30, which is disposed within the air collector 18, purifies the air entering the air collector 18 from the soil vent 14 through the intake port 24, prior inhalation by a human user through the exhaust ports 28. The filter 30 may be made of any of the filter materials known in the art. Thus, for example, it may be of the charcoal-granulated type, or may be a more simple device of the sponge type.

As shown in FIGS. 2 and 4, a valve 32 may be positioned between the air collector intake 24 and the conduit 26 attached to the soil vent 14. The valve 32 is not a necessity for the present invention, but is merely an additional element which may be provided. The valve 32 can is a master on-off valve. The purpose of the valve 32 is to completely shut off the flow of air from the soil vent pipe 14 into the air collector 18. The valve 32 may be any convenient type of on-off valve known in the art. The valve 32 is provided with a handle 34 for convenient operation by the user of the system.

As an other additional feature of the invention, a monitor may be provided to indicate the breathability of the air in the air collector 18. This monitor can comprise an air analyzer sensor 50 connected to a meter 48. The air sensor 50 may be one of any of the air analyzers known in the art, such as a carbon monoxide analyzer.

Referring again to FIG. 3, air is drawn from the air collector 18 through a series of exhaust ports 28. While four exhaust ports 28 have been shown in FIG. 3, a lesser or greater number may be used within the scope of the present invention.

Attached to each of the exhaust ports 28 is an on-off valve 36 having a handle 38 positioned for easy access by the human user of the system. The valves 36 attached to the exhaust ports 28 may be similar to the valve 32 attached to the intake port 24 and may be any type of on-off valve known in the art. The purpose of the valves 36 is to prevent air from flowing from the air collector 18 into the interior of the building 10 unless required.

Attached to each of the valves 36 is a breathing assembly, as shown in FIGS. 2 and 3. The breathing assembly includes an air conduit 46 attached to each of the valve 36, a breathing mask 40 having an exhaust port 60 a strap 42, and an internal diaphragm means, which has not been separately shown. As shown in FIG. 2, the breathing assembly is designed to allow a human user 44 to inhale air from the air collector 18 through the air conduit 46 via the breathing mask 40. The internal diaphragm means within the breathing mask 40 allows the human user to exhale through the exhaust port 60 into the interior environment of the building 10, rather than exhaling back into the air collector. The purpose of the strap 42 is to hold the breathing mask 40 tightly against the face of the human user 44.

A breathing mask 40 with the internal diaphragm means and exhaust port 60 are conventional elements as known in the art. The internal diaphragm means is of the double-diaphragm type which opens the air conduit 46 to the user 44 under the force of inhalation and simutaneously closes the exhaust port 60, and which opens the exhaust port 60 and closes the air conduit 46 under the force of exhalation by the user.

The air conduit 46 is a flexible air conduit as known in the art. The air conduit 46 should be of sufficient length and diameter to allow the human user some movement around the breathing apparatus, and yet to breathe comfortably.

The various elements of the emergency breathing apparatus may be conveniently mounted in an enclosure 52 having a hinged door 54 with a latch 62. The enclosure 52 is a box-like member whose exterior shape is primarily a matter of style. As the conduit 26 connecting the emergency breathing apparatus to the soil vent pipe 14 may be rigid or flexible, the enclosure 52 may be positioned in any convenient location within the structure 10 where access to the soil vent system 14 is possible.

As shown in FIG. 2, the enclosure 52 may be provided with a plurality of hooks 58 from which to suspend the supporting straps 42 of the breathing masks 40. Alternately, the breathing mask 40 with its air conduit 46 may simply be positioned in the bottom portion of the enclosure 52, as shown in FIG. 2.

As seen from the foregoing, the present invention presents a novel emergency breathing system which is simple, economical, and which is completely compatible with all residential and commercial structures, as all such structures have some type of soil vent system. The present invention is especially adaptable for use in bathrooms of high-rise hotel buildings, because if the breathing mask 40 was made watertight, it would be possible, when a hotel room was filled with hot smoke, for the occupant to fill the tub in the bathroom with water, and thereafter enter the tub and breath air from the emergency breathing apparatus. The water in the tub would keep the occupant cool, and the air from the soil vent system, would keep the occupant alive.

In the foregoing description of the present invention, a preferred embodiment has been disclosed, along with several modifications thereto. It is to be understood that other mechanical and design variations are within the scope of the present invention. Thus, by way of example and not of limitation, the air collector could have a different shape and configuration than described, and the intake and exhaust ports could be configured differently than depicted. Accordingly, the invention is not limited to the particular arrangement which has been illustrated and described in detail herein.

What is claimed is:

1. In a structure having sewer pipe means for waste disposal and having vent pipe means connected between said sewer pipe means and the atmosphere for exhausting fumes from said sewer pipe means to the atmosphere, an emergency breathing system for said structure, comprising:

at least one air collector means, disposed within said structure in direct fluidic communication with said vent pipe means, for collecting air from said vent pipe means;

at least one valve means, connected to said air collector means, for enabling air within said air collector means to flow out of said air collector means; and breathing mask means, coupled to said valve means, for allowing a human user to inhale air from said vent pipe means and to exhale air into said structure, whereby when said structure is filled with smoke from a fire, said air in said vent pipe means may sustain the life of said human user.

2. A system as defined in claim 1, wherein said system further comprises:

connecting means, disposed between said vent pipe means and said air collector means, for attaching said air collector means to said vent pipe means.

3. A system as defined in claim 2, wherein said connecting means comprises:

air conduit means disposed between said vent pipe means and said air collector means for fluid flow of air from said vent pipe means into said air collector means.

4. A system as defined in claim 1, wherein said system further comprises:

second valve means, disposed between said vent pipe means and said air collector means, for enabling said air within said vent pipe means to flow into said air collector means.

5. A system as defined in claim 4, wherein said second valve means comprises:

an on-off valve attached to said air collector means and disposed for control by said human user.

6. A system as defined in claim 1, wherein said system further comprises:

filter means, disposed within said air collector means, for purifying said air flowing from said vent pipe means into said air collector means.

7. A system as defined in claim 6, wherein said filter means comprises:

a charcoal filter element removably disposed within said air collector means.

8. A system as defined in claim 1, wherein said system further comprises:

monitoring means, communicating with said air and said air collector means, for indicating the breathability of said air to said human user.

9. A system as defined in claim 8, wherein said monitoring means comprises:

sensor means, in communication with said air in said air collector means, for determining the breathability of said air; and meter means, mounted to said air collector means for viewing by said human user and coupled to said sensor means, for displaying the breathability of said air in said collector means.

10. A system as defined in claim 1, wherein:

said air collector means comprises a sealed receptacle in fluid communication with said air in said vent pipe means, said receptacle being disposed within said structure for access by said human user;

said valve means comprises an on-off valve in fluid communication with said air within said receptacle, whereby air in said receptacle passes first through said valve then into said breathing mask means, said valve being attached to said receptacle for control by said human user; and said breathing mask means comprises flexible air conduit means, attached to said valve and a one-way breathing mask, whereby said human user inhales air through said conduit means and into said breathing mask and exhales air through said breathing mask into the atmosphere.

11. A system as defined in claim 1, wherein:

said structure has at least one lavatory;

at least one of said air collector means is mounted within said lavatory; and at least two of said valve means are mounted to each of said air collector means.

12. An apparatus for allowing a human user to breathe safely internally within a structure whose interior environment is devoid of sufficient breathable air, said structure having a soil vent means connected between sewer pipe means for waste disposal and the atmosphere, said apparatus adapted to communicate with said soil vent means disposed within said structure and comprising;

air collector means, disposed for access by said human user internally within said structure, for allowing fluid flow of air from said soil vent means into said structure;

means for directly fluidically coupling said air collector means to said soil vent means;

breathing means, coupled to said air collector means, for allowing said user to inhale the air within said air collector means; and control means, disposed between said air collector means and said breathing means and accessible by said human user, for enabling air to flow from said air collector means to said breathing means, whereby, when said interior environment of said structure is devoid of breathable air, said human user may, via said control means, enable air to flow from said soil vent means to said breathing means and thereafter breath said air for survival.

13. An appartus as defined in claim 12, wherein said apparatus further comprises:

filter means, removably disposed within said air collector means between said coupling means and said control means, for purifying the air flowing into said air collector means from said soil vent means prior to inhalation by said human user.

14. The apparatus as defined in claim 13, wherein:

said coupling means comprises a conduit attached between said air collector means and said soil vent means; and said filter means comprises a charcoal filter element.

15. An apparatus as defined in claim 13, wherein said apparatus further comprises:

second control means, attached to said coupling means and accessible by said human user, for allowing air within said soil vent means to flow into said air collector means; and monitoring meter means, communicating with said air in said air collector means and viewable by said user, for displaying an indication of the breathability of said air in said air collector means.

16. An apparatus as defined in claim 12, wherein said apparatus further comprises:

enclosure means for enclosing said air collector means, said breathing means, and said control means, with said enclosure means including door means for allowing said human user to access said breathing means and said control means.

17. An apparatus as defined in claim 16, wherein:

said enclosing means comprises a box-like member mounted within said structure for convenient access by said human user; and said door means comprises a movable panel on said box-like member.

18. An apparatus as defined in claim 12, wherein:

said air collector means comprises a generally cylindrical member having an intake port in sealing communication with said soil vent means, whereby air in said soil vent means flows through said intake port into said cylindrical member, said cylindrical member also having at least one exhaust port in sealing communication with said control means, whereby air in said cylindrical member flows through said exhaust port into said control means;

said control means comprises a plurality of on-off valves, one of said valves being attached to each of said exhaust ports; and said breathing means comprises a plurality of one-way breathing masks, one of said masks being attached to each of said valves, whereby said human user may turn said valve on and thereafter inhale air from said soil vent means through said mask and therafter exhale air through said mask into said environment.

19. An apparatus as defined in claim 18, wherein:

said cylindrical member comprises a member of metal material.

20. An apparatus as defined in claim 18, wherein:

said cylindrical member comprises a member of plastic material.

* * * * *